US009748651B2

(12) United States Patent
Orsi et al.

(10) Patent No.: US 9,748,651 B2
(45) Date of Patent: Aug. 29, 2017

(54) COMPOUND COUPLING TO RE-RADIATING ANTENNA SOLUTION

(71) Applicant: DockOn A.G., Zurich (CH)

(72) Inventors: Ryan James Orsi, Kirkland, WA (US); Matthew Robert Foster, San Diego, CA (US); Gregory Poilasne, El Cajon, CA (US); Bryan Joseph Justice, San Diego, CA (US); Jonathan Neil Bringuier, Carlsbad, CA (US)

(73) Assignee: DOCKON AG, Zurich (CH)

( * ) Notice: Subject to any disclaimer, the term of this patent is extended or adjusted under 35 U.S.C. 154(b) by 49 days.

(21) Appl. No.: 14/712,804

(22) Filed: May 14, 2015

(65) Prior Publication Data

US 2015/0249288 A1 Sep. 3, 2015

Related U.S. Application Data

(63) Continuation-in-part of application No. 14/103,684, filed on Dec. 11, 2013, and a continuation-in-part of (Continued)

(51) Int. Cl.
*H01Q 7/00* (2006.01)
*H01Q 1/22* (2006.01)

(52) U.S. Cl.
CPC ..... *H01Q 7/00* (2013.01); *H01Q 1/2233* (2013.01); *Y10T 29/49018* (2015.01)

(58) Field of Classification Search
CPC ..... H01Q 9/30; H01Q 21/30; H01Q 7/005; H01Q 7/00; H01Q 9/0407; H01Q 9/285;

(Continued)

(56) References Cited

U.S. PATENT DOCUMENTS 4,987,421 A 1/1991 Sunahara et al.
4,992,799 A 2/1991 Garay (Continued)

FOREIGN PATENT DOCUMENTS

CN 101849318 A 9/2010
EP 1753080 A1 2/2007

(Continued)

OTHER PUBLICATIONS

International Patent Application No. PCT/US2016/019933; Int'l Search Report and the Written Opinion; dated May 2, 2016; 23 pages.

(Continued)

*Primary Examiner* — Linh Nguyen
(74) *Attorney, Agent, or Firm* — Baker & Hostetler LLP

(57) ABSTRACT

Source radio frequency energy (RF) is coupled wirelessly, with no direct physical contact, between two compound loop (CPL) antennas across a variety of barriers such as plastic, human tissues, glass, and air. The compound coupling interface is highly efficient in transferring the RF energy from a source including one CPL antenna to a destination including a second CPL antenna. A re-radiating structure including a further CPL antenna or a different type of antenna may be connected on the destination side to completely physically isolate the source side from the destination side. When the destination coupling antenna is removed, the source coupling antenna may operate as an efficient radiator at the desired operating frequencies. Likewise, the destination coupling antenna may operate as an efficient radiator in the absence of the source coupling antenna.

19 Claims, 5 Drawing Sheets

Related U.S. Application Data application No. 14/565,379, filed on Dec. 9, 2014, now abandoned.

(60) Provisional application No. 61/966,733, filed on Feb. 28, 2014, provisional application No. 61/913,789, filed on Dec. 9, 2013.

(58) Field of Classification Search
CPC ..... H01Q 21/24; H01Q 1/48; H01Q 25/001; H01Q 21/29
USPC ..... 343/728, 732, 748, 764, 765, 788, 855, 343/866, 700 MS
See application file for complete search history.

(56) References Cited

U.S. PATENT DOCUMENTS

| | | | | |
|---|---|---|---|---|
| 5,212,494 | A | 5/1993 | Hofer et al. | |
| 5,952,982 | A | 9/1999 | Jorgenson et al. | |
| 6,300,914 | B1 * | 10/2001 | Yang | H01Q 1/36 343/702 |
| 6,307,509 | B1 | 10/2001 | Krantz | |
| 6,344,736 | B1 | 2/2002 | Kerrigan et al. | |
| 8,115,683 | B1 | 2/2012 | Stefanakos et al. | |
| 8,144,065 | B2 | 3/2012 | Brown | |
| 8,149,173 | B2 | 4/2012 | Brown | |
| 8,164,532 | B1 | 4/2012 | Brown et al. | |
| 8,253,555 | B2 * | 8/2012 | Stevenson | A61B 5/0031 128/903 |
| 8,259,014 | B2 * | 9/2012 | Wu | H01Q 1/243 343/700 MS |
| 8,350,770 | B1 | 1/2013 | Dawson | |
| 8,502,546 | B2 | 8/2013 | Nyshadham et al. | |
| 8,933,853 | B2 * | 1/2015 | Asanuma | H01Q 7/00 343/702 |
| 2002/0077160 | A1 | 6/2002 | Edwards et al. | |
| 2005/0057405 | A1 * | 3/2005 | Horibe | H01Q 1/007 343/702 |
| 2005/0243005 | A1 | 11/2005 | Rafi et al. | |
| 2007/0139285 | A1 * | 6/2007 | Maruyama | G06K 19/07749 343/741 |
| 2007/0285321 | A1 * | 12/2007 | Chung | H01Q 1/38 343/702 |
| 2009/0073048 | A1 * | 3/2009 | Kim | H01Q 1/243 343/700 MS |
| 2009/0121947 | A1 | 5/2009 | Nysen | |
| 2009/0207092 | A1 | 8/2009 | Nysen et al. | |
| 2010/0117926 | A1 | 5/2010 | Dejean, II | |
| 2010/0171563 | A1 | 7/2010 | Dupuy et al. | |
| 2011/0018775 | A1 * | 1/2011 | Brown | H01Q 1/24 343/748 |
| 2011/0018776 | A1 | 1/2011 | Brown | |
| 2011/0018777 | A1 * | 1/2011 | Brown | H01Q 7/00 343/788 |
| 2011/0032165 | A1 * | 2/2011 | Heng | H01Q 7/005 343/745 |
| 2011/0156852 | A1 | 6/2011 | Unno | |
| 2012/0038519 | A1 * | 2/2012 | Su | H01Q 1/38 343/702 |
| 2012/0056790 | A1 * | 3/2012 | Lee | H01Q 7/00 343/702 |
| 2012/0256808 | A1 * | 10/2012 | Owens | H01Q 1/2233 343/872 |
| 2012/0258661 | A1 | 10/2012 | Nakayama et al. | |
| 2012/0326941 | A1 * | 12/2012 | Su | H01Q 1/38 343/866 |
| 2013/0057440 | A1 * | 3/2013 | Brown | H01Q 1/48 343/749 |
| 2013/0057441 | A1 | 3/2013 | Brown et al. | |
| 2013/0113666 | A1 | 5/2013 | Orsi et al. | |
| 2013/0187674 | A1 | 7/2013 | Rada et al. | |
| 2013/0288618 | A1 | 10/2013 | Becker et al. | |
| 2014/0022142 | A1 | 1/2014 | Brown et al. | |
| 2014/0302800 | A1 | 10/2014 | Manssen et al. | |
| 2015/0303556 | A1 * | 10/2015 | Flores-Cuadras | H01Q 1/085 343/893 |

FOREIGN PATENT DOCUMENTS

| | | | |
|---|---|---|---|
| TW | 201347295 | A | 11/2013 |
| WO | WO 2006/022046 | A1 | 3/2006 |
| WO | WO 2009/118565 | A1 | 10/2009 |
| WO | WO 2010/023503 | A1 | 3/2010 |
| WO | WO 2011/100618 | A1 | 8/2011 |

OTHER PUBLICATIONS

International Patent Application No. PCT/US2015/30667; Int'l Search Report and the Written Opinion; dated Aug. 20, 2015; 11 pages.
International Patent Application No. PCT/US2014/69414; Int'l Preliminary Report on Patentability; dated Jan. 19, 2016; 22 pages.
International Patent Application No. PCT/US2014/69627; Int'l Preliminary Report on Patentability; dated Dec. 11, 2015; 19 pages.

* cited by examiner

COMPOUND COUPLING TO RE-RADIATING ANTENNA SOLUTION

CROSS REFERENCE TO RELATED APPLICATIONS

This application claims benefit under 35 U.S.C. §119(e) of Provisional U.S. Patent Application No. 61/996,773, filed May 14, 2014; this application is also a continuation-in-part of U.S. patent application Ser. No. 14/103,684, filed Dec. 11, 2013; and a continuation-in-part of U.S. patent application Ser. No. 14/565,379, filed Dec. 9, 2014, which claims the benefit of Provisional U.S. Patent Application No. 61/913,789, filed Dec. 9, 2013, the contents of each of which are incorporated herein by reference in their entirety.

BACKGROUND

There are many cases where a radio transceiver needs to be physically located in an environment that is non-ideal for electromagnetic wave propagation, such as below ground level water utility metering pits. Radio signals that are generated from below ground level in such environments are often absorbed, refracted, and reflected, resulting in poor radio frequency (RF) propagation. When the pit structure includes a metal lid, RF propagation may be even more impacted. For fixed water utility metering networks that are comprised of radio transceivers located in the ground attached to water meters and base station receivers located on buildings and towers, poor RF propagation can result in significant cost increases as some meters cannot be read (unless manually) and some can only be read remotely if more base stations are installed. When more base stations are required to supply adequate network coverage, the meter transceivers' transmit power levels often need to be increased, which in turn reduces battery life or requires additional batteries to be included at significant cost, impacting corporate profits significantly.

One solution to mitigating poor RF propagation environments, such as the below ground water pit example, is to transfer the RF energy from the radio transceiver below ground to a radiating structure located above ground, which is a much more suitable RF propagation environment. In addition, the physical environment of the water pit example above requires the meter transceiver and associated electronics to be completely hermetically sealed to guarantee a twenty year operating life and maintain a barrier for water vapor that destroys the electronics over time. Because of this constraint, no physical contacts may be used to transfer the RF energy from the meter transceiver located below ground, to the above ground radiating structure, such as cables or contact connectors.

DETAILED DESCRIPTION OF ILLUSTRATIVE EMBODIMENTS

Figure 1:
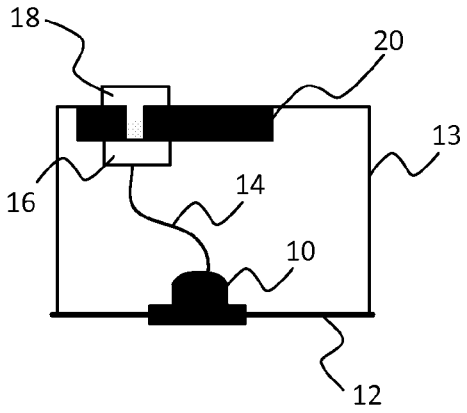
FIG. 1 is a side view of a water meter connected to a compound coupled transmitter assembly in accordance with an embodiment.

Wireless communication devices are finding applications that require new antenna designs to address inherent limitations of the devices and to enable new capabilities. With conventional antenna structures, a certain physical volume is required to produce a resonant antenna structure at a particular frequency and with a particular bandwidth. However, effective implementation of such antennas is often confronted with size constraints due to a limited available space in the device.

Antenna efficiency is one of the important parameters that determine the performance of the device. In particular, radiation efficiency is a metric describing how effectively the radiation occurs, and is expressed as the ratio of the radiated power to the input power of the antenna. A more efficient antenna will radiate a higher proportion of the energy fed to it. Likewise, due to the inherent reciprocity of antennas, a more efficient antenna will convert more of a received energy into electrical energy. Therefore, antennas having both good efficiency and compact size are often desired for a wide variety of applications.

Conventional loop antennas are typically current fed devices, which generate primarily a magnetic (H) field. As such, they are not typically suitable as transmitters. This is especially true of small loop antennas (i.e. those smaller than, or having a diameter less than, one wavelength). The amount of radiation energy received by a loop antenna is, in part, determined by its area. Typically, each time the area of the loop is halved, the amount of energy which may be received is reduced by approximately 3 dB. Thus, the size-efficiency tradeoff is one of the major considerations for loop antenna designs.

Voltage fed antennas, such as dipoles, radiate both electric (E) and H fields and can be used in both transmit and receive modes. Compound antennas are those in which both the transverse magnetic (TM) and transverse electric (TE) modes are excited, resulting in performance benefits such as wide bandwidth (lower Q), large radiation intensity/power/gain, and good efficiency. There are a number of examples of two dimensional, non-compound antennas, which generally include printed strips of metal on a circuit board. Most of these antennas are voltage fed. An example of one such antenna is the planar inverted F antenna (PIFA). A large number of antenna designs utilize quarter wavelength (or some multiple of a quarter wavelength), voltage fed, dipole antennas.

Compound loop (CPL) antennas are finding applications that are not appropriate for other types of antennas. The CPL antenna includes a loop and a radiator, but may also include multiple radiators or radiating elements that are part of the loop. Similar to a conventional loop antenna, that is typically current fed, the loop element of the CPL antenna may generate a magnetic (H) field. The radiating element, having the series resonant circuit characteristics, effectively operates as an electric (E) field radiator (which of course is an E field receiver as well due to the reciprocity inherent in antennas). In order to operate as a CPL antenna, the generating/receiving E and H fields must be substantially orthogonal to each other, even though the loop and radiator element may be coplanar. This orthogonal relationship has the effect of enabling the electromagnetic waves emitted by the antenna to effectively propagate through space. In the absence of the E and H fields arranged orthogonal to each other, the waves will not propagate effectively beyond short distances. To achieve this effect, the radiating element is generally placed at a position where the E field produced by the radiating element is 90° or 270° out of phase relative to the H field produced by the loop element. Specifically, the radiating element is placed at the substantially 90° (or) 270° electrical length along the loop element from a feed point. Alternatively, the radiating element may be connected to a location of the loop element where current flowing through the loop element is at a reflective minimum.

In addition to the orthogonality of the E and H fields, it is desirable that the E and H fields are comparable to each other in magnitude. These two factors, i.e., orthogonality and comparable magnitudes, may be appreciated by looking at the Poynting vector (vector power density) defined by P=E×H (Volts/m×Amperes/m=Watts/m2). The total radiated power leaving a surface surrounding the antenna is found by integrating the Poynting vector over the surface. Accordingly, the quantity E×H is a direct measure of the radiated power, and thus the radiation efficiency. First, it is noted that when the E and H are orthogonal to each other, the vector product gives the maximum. Second, since the overall magnitude of a product of two quantities is limited by the smaller, having the two quantities (|H| and |E| in this case) as close as possible will give the optimal product value. As explained above, in the CPL antenna, the orthogonally is achieved by placing the radiating element at the substantially 90° (or) 270° electrical length along the loop element from a feed point. Furthermore, the shapes and dimensions of the loop element and the radiating element can be each configured to provide comparable, high |H| and |E| in magnitude, respectively. Therefore, in marked contrast to a conventional loop antenna, the CPL antenna, such as a planar CPL antenna, can be configured not only to provide both transmit and receive modes, but also to increase the radiation efficiency.

Size reduction can be achieved by introducing a series capacitance in the loop element and/or the radiating element of the CPL antenna. Such an antenna structure, referred to as a capacitively-coupled compound loop antenna (C2CPL), has been devised to provide both transmit and receive modes with greater efficiency and smaller size than a conventional antenna. Examples of structures and implementations of the C2CPL antennas are described in U.S. patent application Ser. No. 13/669,389, entitled "Capacitively Coupled Compound Loop Antenna," filed Nov. 5, 2012, which is incorporated herein by reference.

The compound coupling interface described herein is a passive, non-contact system for efficiently transferring the RF energy from one CPL antenna to another CPL antenna, thereby requiring relatively little power and resulting in little dB loss. Rather, the two CPL antennas are both capactively coupled and inductively coupled at the same time, which is possible due to the unique operating structure of the CPL antenna.

While other wireless antenna coupling designs have been implemented in the past, such designs typically utilize one of two possible simple-field coupling technologies: substantially capacitive coupling or substantially inductive coupling. Capacitive coupling using parallel plates of conductive material is inherently highly sensitive to translation and alignment between the two coupling structures. The coupling areas are maximized along the edges of conductive plates and very slight translations (fractions of a millimeter) can cause frequency shift and significant increases in loss of RF energy. Capacitive coupling is more sensitive to material interactions because of the fringe electric fields along the edges of the conductive plates. These drawbacks have limited the use of capacitive coupling in commercial applications where low coupling loss is desired.

Unlike the compound coupling architecture of the present disclosure, it is also typically not possible to realize a dual mode radiator and a coupler with one artwork. One of the two capacitive plates cannot typically function as both an antenna and a coupler, both at the same frequency of operation.

Inductive coupling using a pair of conductive loops requires a larger aperture, and thus larger volume to implement, than capacitive or compound coupling to achieve low coupling loss. When the pair of inductive loops are realized to be less than a wavelength in circumference (small loops), in order to reduce overall size, the feeding mechanism becomes more critical to maintain low coupling loss. Typically, the small loops are fed with unbalanced feeds and common mode current can interact with the feed, reducing coupling efficiency and increasing RF energy loss.

Unlike the compound coupling architecture of the present disclosure, it is also typically not possible to realize a dual mode radiator and a coupler with one artwork. One of the two loops cannot typically function as both an antenna and coupler both at the same frequency of operation.

The compound coupling architecture of the present disclosure enables both CPL antennas to simultaneously capactively couple and inductively couple, with relatively high efficiency and relatively little coupling loss. In addition, when the CPL antennas are not being used to couple with one another, either or both CPL antennas can function as a radiator.

Since the two CPL antennas of the compound coupling system do not require any physical connections in order to couple, both CPL antennas and their associated assemblies may be completely sealed, i.e., hermetically sealed, so as to protect the antennas, the associated assembly circuitry, and the re-radiating antenna structure from any type of environmental intrusion, such as water. One particular appropriate application is that of a water meter wireless endpoint. Water lines are typically buried underground. Water meters that measure the flow (and therefore the usage of water) through such lines are usually located in a pit buried in the ground. The pits are typically constructed from rigid plastic or non-corrosive metal and can extend many feet into the ground, with the water pipe running through the bottom of the pit. The top of the pit is flush with the ground surface and is usually covered with a lid. The pits are not water proof, so due to water leaks, high water tables, and run-off from other sources, the pits may be completely flooded. The water meter generates a signal that is output through a sealed cable extending from the meter. The cable typically connects to an electrical device that receives the metered signal from the water meter and transmits the metered signal to a remotely located host station. Merely being buried in the ground is one obstacle to transmitting a strong signal. Interference from surround water, the material forming the pit and the material forming the lid can be further factors limiting the efficiency of the transmission of the electrical device.

In an embodiment illustrated in FIG. 1, a meter 10 is attached to a pipe 12 within a pit 13. The meter is connected by a cable 14 to a printed circuit board (PCB) assembly 16 containing the electronics necessary to perform some particular function. In other embodiments, the PCB assembly 16 could be integrated with the meter 10 so as to eliminate the need for the cable 14 or the meter 10 could be compound coupled to the PCB assembly in place of the cable 14, as further described below. The PCB assembly 16 is compound coupled to a re-radiating assembly 18 that is installed within and/or on top of the lid 20 to the pit 13.

Figure 2:
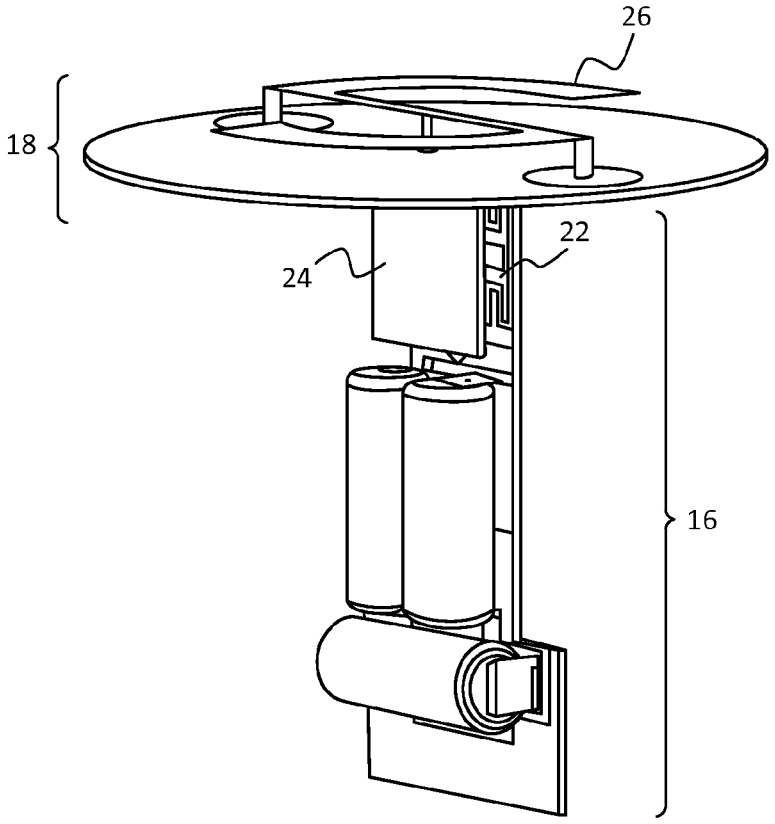
FIG. 2 is a perspective view of an embodiment of a below ground electrical device assembly having a half wave compound loop (CPL) antenna wirelessly coupled to a half wave CPL antenna of an above-ground re-radiator assembly having a different type of antenna performing re-radiation.

FIG. 2 further illustrates the PCB assembly 16 and the re-radiator assembly 18 of FIG. 1. The PCB assembly 16 may be hermetically sealed inside an enclosure, which may be made of plastic, metal, and/or other materials. Inside the enclosure, the assembly 16 includes electronics for receiving and analyzing the metered signal from the meter and sufficient power supplies to operate the assembly for an extended period of time, as many as 5, 10, or 20 years, without maintenance or recharging. A compound loop (CPL) antenna 22 may be printed on the PCB of the PCB assembly 16. In one example, the CPL antenna 22 may operate as an efficient antenna tuned for the 900 MHz ISM band when no other antenna/coupler structure is present. When CPL antenna 22 cannot achieve sufficient transmission capacity (i.e., distance or reliability) due to interference within the pit 13 or from the lid 20, a re-radiator assemble 18 may be added. The re-radiator assembly 18 may be within a second hermetically sealed plastic enclosure which includes two more compound CPL antennas, CPL antenna 24 (on the opposite side of the PCB shown) and CPL antenna 26. CPL antenna 24 is oriented parallel to CPL antenna 22 so as to be spaced away and not in direct contact with CPL antenna 22. CPL antenna 24 may operate as a an efficient antenna tuned for a particular frequency band, such as the 900 MHz ISM band, but will also operate as a coupler when placed in close proximity to CPL antenna 22, in which case CPL antenna 22 will also operate as a coupler.

Since the two antennas 22 and 24 are compound loop antennas, which enable simultaneous capactive coupling and inductive coupling, the coupling arrangement between the two CPL antennas is referred to herein as "compound coupling." The two CPL antennas 22 and 24 are placed parallel to each other, but not in direct contact, to efficiently transfer RF energy from the source of the PCB assembly 16 to the re-radiating CPL antenna 26. When the CPL antennas 22 and 24, which may both be half wave CPL antennas, are configured in close proximity to one another, such as about 5 mm, both antennas may operate as efficient wireless compound couplers, transferring RF energy across a boundary of various dielectric material with approximately 1 dB loss. CPL antenna 26 is also located in the second plastic housing. While it is described in this embodiment as a low profile, vertically polarized CPL antenna, operating as a re-radiator, the antenna need not be a CPL antenna and other types of antennas could be used in place of a CPL.

Figure 3:
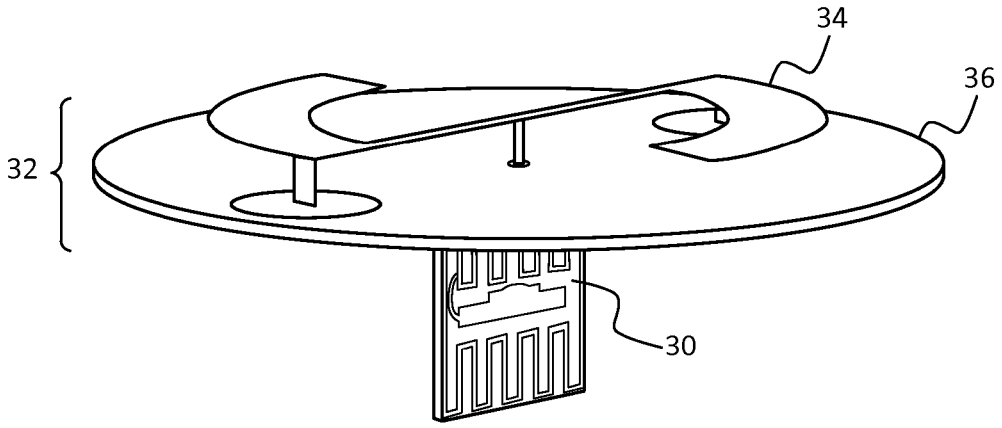
FIG. 3 is a more detailed, perspective view of an embodiment of a re-radiator assembly similar to that of FIG. 2 with a different type of antenna performing compound coupling.

FIG. 3 illustrates further details of a different type of CPL antenna 30 of a re-radiator assembly 32, having the same type of re-radiator antenna 34 shown in FIG. 2 as CPL antenna 26. In this embodiment, CPL antenna 30 is a C2CPL antenna, as would be the corresponding coupling antenna of the PCB assembly (not shown in FIG. 3). The low profile, vertically polarized CPL antenna 34 is mounted to a finite ground plane 36 shared with the CPL antenna 30. A similar arrangement is used in FIG. 2 as well.

Figure 4:
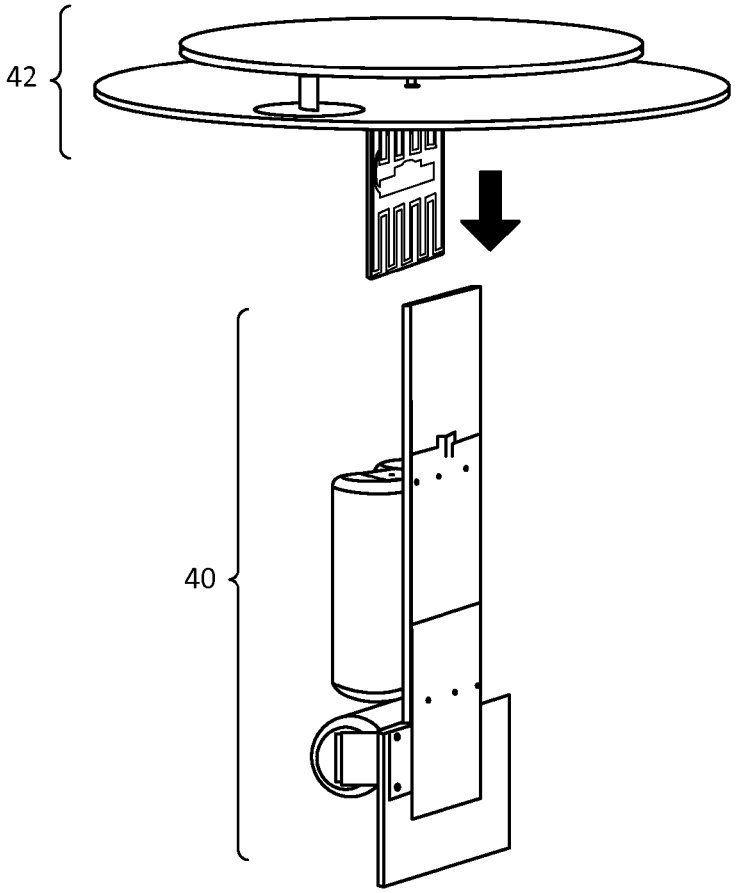
FIG. 4 is a perspective view illustrating the coupling interface between the below ground electrical device assembly and the re-radiator assembly.

FIG. 4 provides further details regarding the physical orientation required for the compound coupling between the CPL antennas of the PCB assembly 40 and the re-radiator assembly 42.

Figure 5:
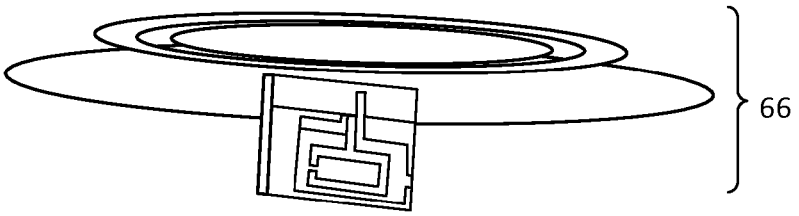
FIG. 5 is a perspective view of an embodiment of a re-radiator assembly having a capacitively coupled CPL (C2CPL) antenna.
Figure 6:
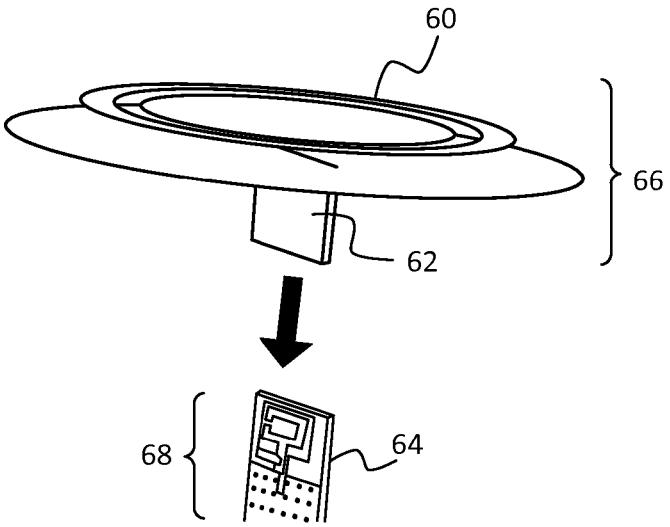
FIG. 6 is a perspective view illustrating the coupling interface between an electrical device assembly and the re-radiator assembly of FIG. 5.
Figure 7:
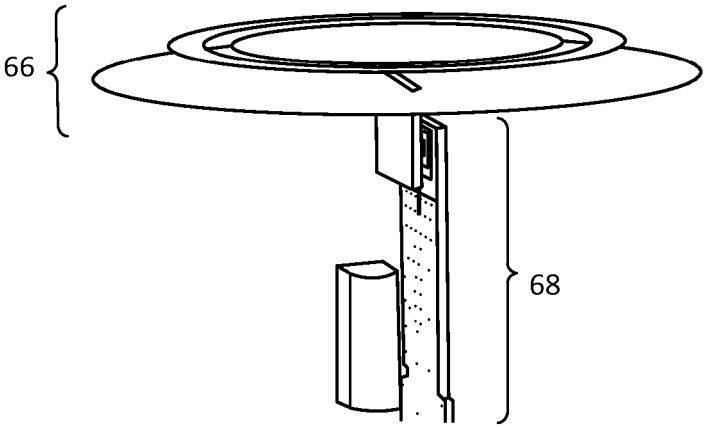
FIG. 7 is a perspective view of the electrical device assembly and re-radiator assembly of FIG. 5 in coupling mode.

Other examples of a compound coupling to re-radiating antenna solution can be seen in FIGS. 5, 6 and 7, where the pair of compound coupling CPL antennas are implemented using varying loop wavelength architectures. For example, FIG. 6 is a perspective view illustrating a passive re-radiating component 60 of a C2CPL 62 to C2CPL 64 compound coupled system, with FIG. 5 providing some details regarding the re-radiator assembly 66 and FIG. 7 providing details of the operating arrangement between the re-radiator assembly 66 of FIG. 5 and the PCB assembly 68.

Figure 8:
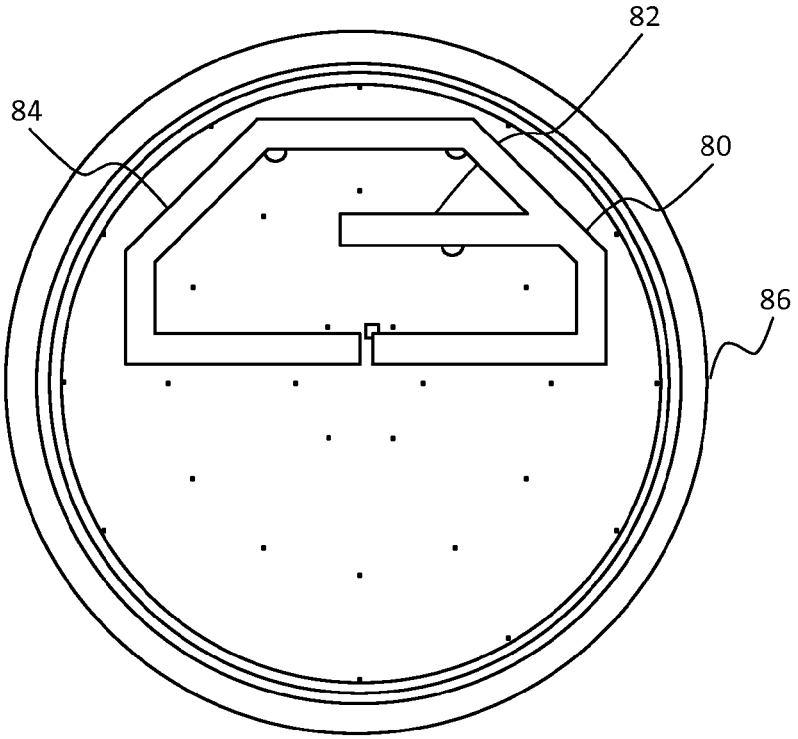
FIG. 8 is a top view of an embodiment of a full wave CPL antenna.
Figure 9:
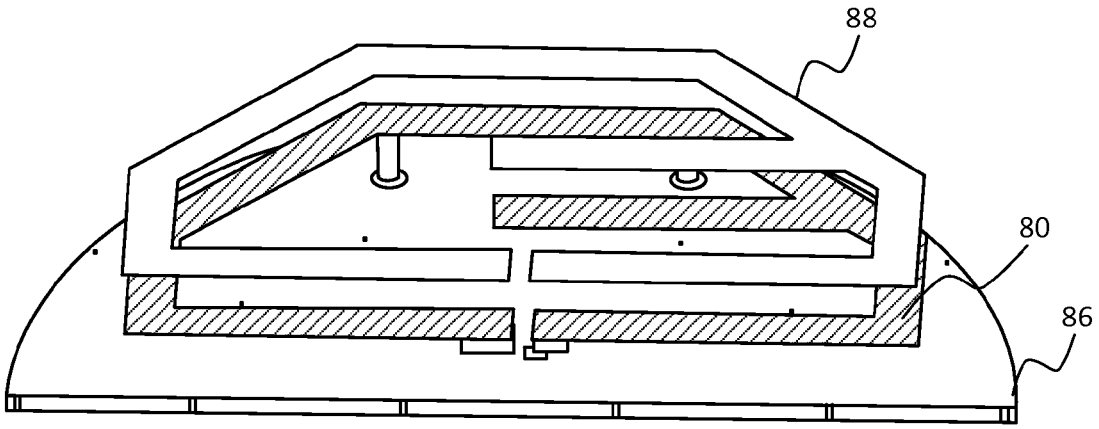
FIG. 9 is a perspective view of an embodiment of two full wave CPL antennas in a couple arrangement.
Figure 10:
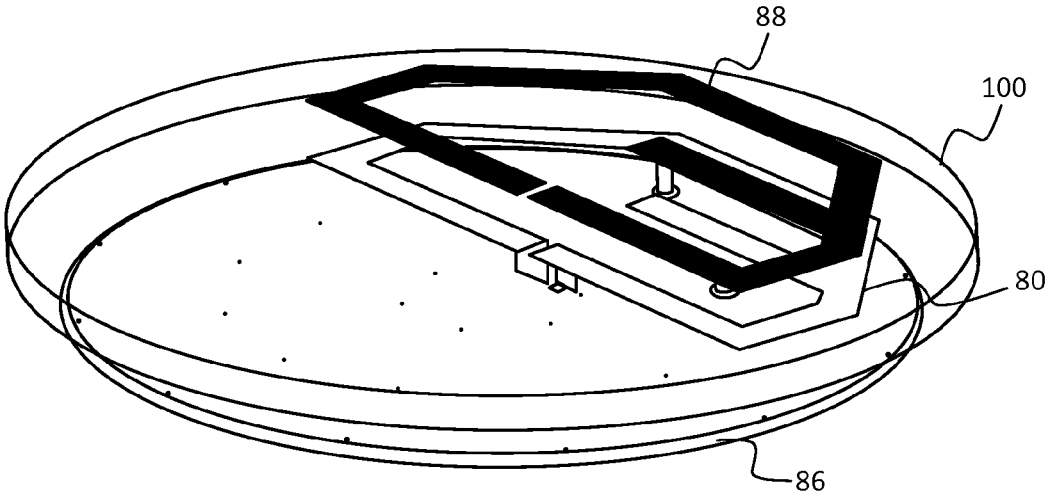
FIG. 10 is a perspective view of an embodiment of two full wave CPL antennas coupling through a glass medium.

A full wave CPL antenna to a full wave CPL antenna compound coupling is illustrated with respect to FIGS. 8, 9 and 10. FIG. 8 provides a top view of a full wave CPL antenna 80, having a radiator 82 and a loop 84, mounted on a finite shared ground plane 86. The common artwork of CPL antenna 80 may operate as an antenna or as a compound coupler. A perspective view showing two full wave CPL antennas 80 and 88 mounted in a compound coupling arrangement is illustrated in FIG. 9. The CPL antenna 80 may be mounted on the ground plan 86. The CPL antenna 88 would not be mounted on the ground plan 86 or in direct physical contact with CPL antenna 80, but may be indirectly connected through a medium such as the glass plate 100 of FIG. 10, or some other type of medium, including plastic, human tissue, and air to name a few. This type of arrangement may make it possible for both of the compound coupling antennas to be located within a single enclosure, but still operate in compound coupling mode. Alternatively, the glass plate 100 could be part of structure within which CPL antenna 88 is mounted, or the glass plate 100 could be placed between the enclose structures of both compound coupling antennas. For example, referring back to FIG. 1, the glass plate 100 could be mounted within the lid 20 to the pit 13, with the PCB assembly 16 placed against a first side of the glass on the inside of the pit 13 and re-radiator assembly 18 placed on a second side of the glass on the outside of the pit 13.

While the water meter pit example is one particularly appropriate example, the present disclosure is not limited to just that particular application and could be utilized in any application where it is useful to have two different assemblies in wireless communication, but located in close proximity to one another. For example, Wi-Fi enabled devices are often designed to lay flat for various industrial design and aesthetic reasons. For example, a 802.11ac 5 GHz enabled Wi-Fi router may lay down flat on a desktop or table. The efficient propagation of radio waves from this flat lying device at 5 GHz is known in the field to be dependent on maximizing the vertical polarization (electric field polarization with respect to the earth) of the antenna system of the device. This performance requirement has led industry designers and manufacturers of such devices to utilize a certain type of antenna implementation: those that are separated from the main device printed circuit board (PCB), connected with cables to the PCB and mounted perpendicular to the PCB along the perimeter of the plastic housing. This antenna implementation is often referred to as off-board and is inherently more expensive than if an antenna solution were to be printed on the main PCB directly, in the same plane as the PCB. The cost of coax cable, connectors, and manual assembly processes of the off-board antennas drive the added expense. Printed, or on-board antennas are far more cost effective however, when implemented at 5 GHz in a lying flat device, but the polarization is a mix of horizontal and vertical so the performance suffers.

Figure 11:
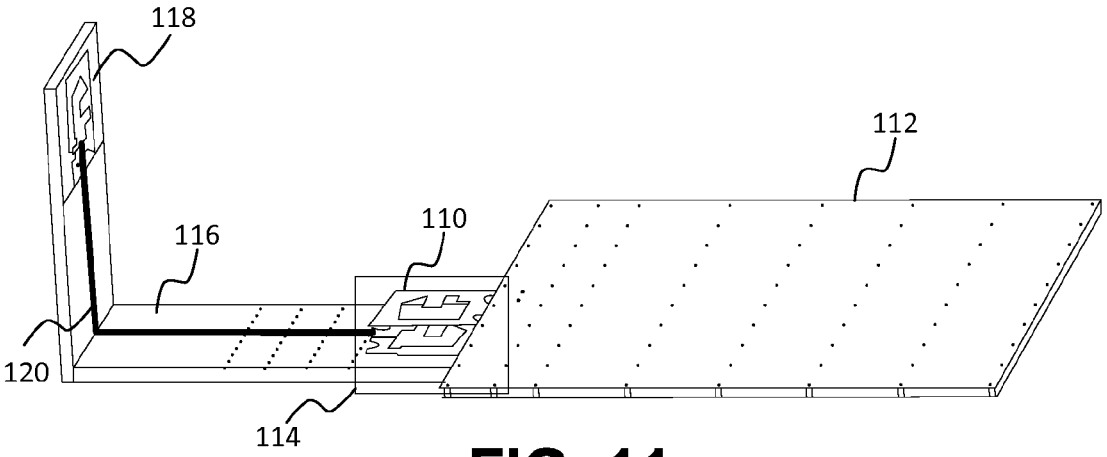
FIG. 11 is a perspective view of an embodiment of a printed CPL antenna on a PCB coupled to a second printed CPL antenna on a separate assembly, where the second CPL antenna is connected to a third CPL antenna the re-radiates the RF energy from the first antenna.

FIG. 11 illustrates an embodiment of a compound coupling antenna and a re-radiator antenna that realizes both the cost benefits of printed antennas and the performance increase of predominately vertical polarization. A CPL antenna 110 is printed on the main PCB 112. A second CPL antenna 114 may be printed on a separate PCB assembly 116 from the main PCB 112, which can be formed from printed flex PCB or other known manufacturing techniques. A third antenna 118 may be physically connected to CPL antenna 114 by connector 120 and operate as the re-radiator. Antenna 110 and antenna 114 comprise the compound coupling structure and do not radiate. Antenna 118 may be another CPL antenna that re-radiates the RF energy in an optimal vertical polarization, but need not be a CPL and could be another type of antenna. Many other types of compound coupling antenna and re-radiator antenna implementations should be apparent to a person of ordinary skill in the art upon reading the present disclosure and this disclosure is not limited to the just the embodiments disclosed herein.

It should be appreciated that orientations of the pair of compound coupling CPL antennas, as described above, are only given by way of example. To meet space and design limitations, or other requirements of implementations, the compound coupling CPL antennas may be oriented in a variety of ways relative to their surroundings. For example, in the example illustrated in FIGS. 1-7, the coupling CPL antennas are perpendicular to the re-radiating antenna. In other aspects contemplated herein, the coupling CPL antennas may be oriented in any manner, at any angle including parallel to, the re-radiating antenna. Similarly, the examples described in reference to FIGS. 8-10 may be oriented differently, and so on, as long as the two coupling CPL antennas are parallel or substantially parallel to one another.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While certain example embodiments have been described, these embodiments have been presented by way of example only, and are not intended to limit the scope the disclosures herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions and changes in the form of the methods and systems described herein may be made without departing from the spirit of the disclosures herein. The accompanying claims and their equivalents are intended to cover such forms or modifications as would fall within the scope and spirit of certain of the disclosures herein.

What is claimed:

1. A compound coupler, comprising:

a first compound loop antenna connected to an electrical circuit, the first compound loop antenna including at least a first radiator element and a first loop element; and a second compound loop antenna connected to a re-radiator antenna, the second compound loop antenna including at least a second radiator element and a second loop element, the second compound loop antenna being placed in close proximity to, but not in direct contact with, the first compound loop antenna, wherein the first compound loop antenna compound couples with the second compound loop antenna to wirelessly transmit RF energy from the electrical circuit to the second compound loop antenna for transmission by the re-radiator antenna, wherein the compound coupling between the first compound loop antenna and the second compound loop antenna is simultaneously capacitive and inductive, and is associated with a coupling efficiency that is not highly sensitive to translation and alignment between the first compound loop antenna and the second compound loop antenna.

2. The compound coupler of claim 1, wherein the first compound loop antenna and the second compound loop antenna are separated by a gap comprising a dielectric material.

3. The compound coupler of claim 1, wherein the first compound loop antenna defines a first plane and the second compound loop antenna defines a second plane, and wherein the first plane is oriented substantially parallel to the second plane.

4. The compound coupler of claim 1, wherein the first compound loop antenna passively compound couples with the second compound loop antenna.

5. The compound coupler of claim 1, wherein the first compound loop antenna is housed by a first enclosure, and wherein the second compound loop antenna is housed by a second enclosure separate from the first enclosure.

6. The compound coupler of claim 5, wherein at least one of the first enclosure or the second enclosure is hermetically sealed.

7. The compound coupler of claim 1, wherein the first compound loop antenna and the second compound loop antenna are housed by a single enclosure, and wherein the first compound loop antenna and the second compound loop antenna are separated by a medium, the medium comprising plastic, human tissue, free space, or glass.

8. The compound coupler of claim 1, wherein the second compound loop antenna is connected to the re-radiator antenna via a length of transmission line.

9. The compound coupler of claim 8, wherein the electrical circuit comprises a water meter, and wherein the water meter is connected to the first compound loop antenna via a cable.

10. The compound coupler of claim 1, wherein the re-radiator antenna comprises a vertically polarized compound loop antenna or a capacitively coupled compound loop antenna.

11. The compound coupler of claim 10, wherein the re-radiator antenna is mounted to a finite ground plane shared with the second compound loop antenna.

12. The compound coupler of claim 1, wherein the first compound loop antenna and the second compound loop antenna each comprise a capacitively coupled compound loop antenna.

13. The compound coupler of claim 1, wherein the first compound loop antenna and the second compound loop antenna each comprise at least one of a quarter wavelength, a half wavelength, or a full wavelength.

14. A combination compound coupler and radiator, comprising:

a first compound loop antenna connected to an electrical circuit, the first compound loop antenna including at least a first radiator element and a first loop element and configured to operate as a radiator; and a second compound loop antenna connected to a re-radiator antenna, the second compound loop antenna including at least a second radiator element and a second loop element, wherein, when the second compound loop antenna is placed in close proximity to, but without touching, the first compound loop antenna, the first compound loop antenna compound couples with the second compound loop antenna to wirelessly transmit RF energy from the electrical circuit to the second compound loop antenna for transmission by the re-radiator antenna;

wherein when the first compound loop antenna is not in close proximity to the second compound loop antenna, the first compound loop antenna wirelessly transmits the RF energy from the electrical circuit; and wherein the compound coupling between the first compound loop antenna and the second compound loop antenna is simultaneously capacitive and inductive, and is associated with a coupling efficiency that is not highly sensitive to translation and alignment between the first compound loop antenna and the second compound loop antenna.

15. The combination compound coupler and radiator of claim 14, wherein the first compound loop antenna and the second compound loop antenna are separated by a gap comprising a dielectric material.

16. The combination compound coupler and radiator of claim 14, wherein the first compound loop antenna defines a first plane and the second compound loop antenna defines a second plane, and wherein the first plane is oriented substantially parallel to the second plane.

17. The combination compound coupler and radiator of claim 14, wherein the re-radiator antenna comprises a vertically polarized compound loop antenna or a capacitively coupled compound loop antenna.

18. The combination compound coupler and radiator of claim 14, wherein the first compound loop antenna and the second compound loop antenna each comprise a capacitively coupled compound loop antenna.

19. A method of compound coupling an electric circuit to a re-radiator antenna comprising:

connecting the electric circuit to a first compound loop antenna;

connecting the re-radiator antenna to a second compound loop antenna;

aligning the first compound loop antenna in a parallel orientation relative to the second compound loop antenna, wherein upon energizing the electric circuit, RF energy is simultaneously capacitively and inductively compound coupled from the first compound loop antenna to the second compound loop antenna for transmission by the re-radiator antenna, and a coupling efficiency is not highly sensitive to translation and alignment between the first compound loop antenna and the second compound loop antenna.

* * * * *